US005624889A

United States Patent [19]

Ozaki et al.

[11] Patent Number: 5,624,889

[45] Date of Patent: *Apr. 29, 1997

[54] LUBRICATING GREASE COMPOSITION

[75] Inventors: Takahiro Ozaki; Tomoo Munakata; Yasushi Kawamura; Kazunori Takase; Tetsuo Tsuchiya, all of Tokyo, Japan

[73] Assignee: Showa Shell Sekiyu K.K., Tokyo, Japan

[ * ] Notice: The term of this patent shall not extend beyond the expiration date of Pat. No. 5,487,837.

[21] Appl. No.: 565,017

[22] Filed: Nov. 30, 1995

[30] Foreign Application Priority Data

Dec. 2, 1994 [JP] Japan ..... 6-329435

[51] Int. Cl.[6] ..... C10M 141/06

[52] U.S. Cl. ..... 508/162; 508/438

[58] Field of Search ..... 252/32.7 E, 33.6, 252/25, 40.7, 46.6; 508/162, 371, 438

[56] References Cited

U.S. PATENT DOCUMENTS

| | | | |
|---|---|---|---|
| 4,514,312 | 4/1985 | Root et al. . | |
| 4,787,992 | 11/1988 | Waynick . | |
| 4,840,740 | 6/1989 | Sato et al. . | |
| 5,449,471 | 9/1995 | Ozaki et al. | 252/42.7 |
| 5,487,837 | 1/1996 | Ozaki et al. | 252/25 |

FOREIGN PATENT DOCUMENTS

| | | | |
|---|---|---|---|
| 633304 | 1/1995 | European Pat. Off. | C10M 169/06 |
| 661378 | 7/1995 | European Pat. Off. | C10M 169/06 |
| 2090189 | 1/1972 | France | C10M 5/00 |
| 4-34590 | 6/1992 | Japan | C10M 169/06 |
| 4-65119 | 10/1992 | Japan | C10M 113/08 |
| 2255346 | 11/1992 | United Kingdom | C10M 169/06 |

OTHER PUBLICATIONS

Patent Abstracts of Japan, vol. 012 No. 070 (C–479), 4 Mar. 1988 for JP–A–62–207397 (Kyodo Yushi KK) 11 Sep. 1987.

*Primary Examiner*—Jacqueline V. Howard
*Assistant Examiner*—Cephia D. Toomer
*Attorney, Agent, or Firm*—Sughrue, Mion, Zinn Macpeak & Seas

[57] ABSTRACT

A lubricating grease composition includes a grease containing a base oil and a thickening agent consisting of a mixture of tricalcium phosphate represented by the formula $$Ca_3(PO_4)_2$$

and a urea compound and, incorporated as additives in the grease, (A) a sulfurized molybdenum dialkyldithiocarbamate represented by the formula

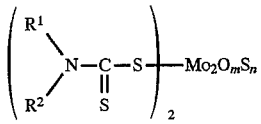

wherein $R^1$ and $R^2$ each independently represents a group selected from the group consisting of alkyl groups having from 1 to 24 carbon atoms; m is 0 or an integer of from 1 to 3; and n is an integer of from 1 to 4; provided that m+n=4, and (B) triphenyl phosphorothionate represented by the formula

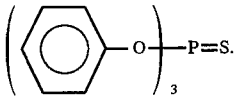

4 Claims, No Drawings

LUBRICATING GREASE COMPOSITION

FIELD OF THE INVENTION

The present invention relates to a grease composition for use in automotive constant-velocity joints (CVJ), ball joints, and wheel bearings, and in various parts which need lubrication, e.g., bearings and gears, in machinery in the steel industry and other industries.

BACKGROUND OF THE INVENTION

With the recent industrial trend toward labor saving or toward miniaturization, weight reduction, and speed increase in machinery, there is a growing desire for a high-grade lubricating grease having a combination of good performance characteristics, such as heat resistance, load carrying capacity, anti-wear property, and a long life, for use in application to the bearings and gears of such industrial machinery. For example, the lubrication of CVJs, which are frequently employed in front-drive vehicles, necessitate a lubricating grease excellent in durability, anti-wear property, and heat resistance, because of the trend toward power and speed increase in motor vehicles and weight reduction in CVJ's themselves.

In ironworks, on the other hand, rolling mills have gradually shifted to higher-speed mills or mills having sealed bearings, as a result of the simplification and modernization of equipment. Because of this, lubricating greases for this use are not only strongly required to contribute to energy saving, but also required to have a combination of good performance characteristics including load carrying capacity, heat resistance, and a long life. Thus, the performance characteristics required of lubricating greases for use in various industrial fields including the automobile and the steel industries are becoming more severe with the progress of machines. The main demand of greases for machinery has been shifting from lithium soap greases called "universal greases" or "multipurpose greases" to urea greases, which have excellent heat resistance and are capable of producing a synergistic effect with an additive to attain a reduction of friction.

Under these circumstances, representative techniques are described in, e.g., U.S. Pat. Nos. 4,840,740, 4,514,312, and 4,787,992. U.S. Pat. No. 4,840,740 discloses a grease composition comprising a urea grease containing a combination of an organomolybdenum compound and zinc dithiophosphate. U.S. Pat. No. 4,514,312 discloses a grease composition comprising a urea grease containing an aromatic amine thiophosphate. U.S. Pat. No. 4,787,992 discloses a grease composition comprising a grease thickened with a Ca soap, a Ca-complex soap, or a mixture of any of these with a urea compound and containing a combination of calcium carbonate and tricalcium phosphate as additives. JP-B-4-34590 (the term "JP-B" as used herein means an "examined Japanese patent publication") discloses a composition comprising a urea grease containing, as an essential component, a sulfur-phosphorus extreme-pressure additive comprising a combination of (A) a sulfurized molybdenum dialkyldithiocarbamate and (B) at least one member selected from the group consisting of sulfurized fats and oils, sulfurized olefins, tricresyl phosphate, trialkyl thiophosphates, and zinc dialkyldithiophosphates. Further, JP-B-4-65119 discloses a lubricating grease composition obtained by kneading a mixture of a base oil and tricalcium phosphate, which is represented by the formula $Ca_3(PO_4)_2$.

However, these patented compositions have drawbacks as follows. The compositions based on a urea grease each is still insufficient in load carrying capacity and heat resistance, although it is expected that the grease and the additive(s) produce a synergistic effect to reduce friction. On the other hand, the tricalcium phosphate grease has a drawback that it is slightly inferior in anti-wear property to the urea greases although superior in load carrying capacity and heat resistance.

SUMMARY OF THE INVENTION

An object of the present invention is to further improve urea greases and the tricalcium phosphate grease disclosed in JP-B-4-65119 to thereby provide a lubricating grease composition superior to those greases in load carrying capacity, anti-wear property, heat resistance, etc.

The present invention relates to a lubricating grease composition which comprises a grease comprising a base oil and a thickening agent consisting of a mixture of tricalcium phosphate represented by the formula $$Ca_3(PO_4)_2$$

and a urea compound and, incorporated as additives in the grease, (A) a sulfurized molybdenum dialkyldithiocarbamate represented by the formula

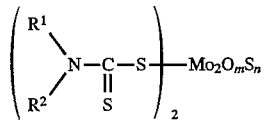

wherein $R^1$ and $R^2$ each independently represents a group selected from the group consisting of alkyl groups having from 1 to 24 carbon atoms; m is 0 or an integer of from 1 to 3; and n is an integer of from 1 to 4; provided that m+n=4 and (B) triphenyl phosphorothionate represented by the formula

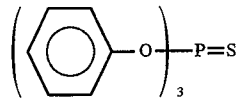

wherein the thickening agent, component (A), and component (B) are present in an amount of from 2 to 35% by weight, from 0.5 to 10% by weight, and from 0.1 to 10% by weight, respectively, based on the total weight of the composition.

DETAILED DESCRIPTION OF THE INVENTION

Examples of the sulfurized molybdenum dialkyldithiocarbamate of component (A) include sulfurized molybdenum diethyldithiocarbamate, sulfurized molybdenum dibutyldithiocarbamate, sulfurized molybdenum diisobutyldithiocarbamate, sulfurized molybdenum di(2-ethylhexyl)dithiocarbamate, sulfurized molybdenum diamyldithiocarbamate, sulfurized molybdenum diisoamyldithiocarbamate, sulfurized molybdenum dilauryldithiocarbamate, and sulfurized molybdenum distearyldithiocarbamate. The addition amount of component (A) is from 0.5 to 10% by weight, preferably from 0.5 to 5% by weight, based on the total amount of the composition. If the amount thereof is below 0.5% by weight, the effect of improving anti-wear property and reducing friction is insufficient. If the amount thereof exceeds 10% by weight, the desired effect is not heightened any further.

Triphenyl phosphorothionate of component (B) is used in an amount of from 0.1 to 10% by weight, preferably from 0.1 to 5% by weight, based on the total amount of the composition. If the amount thereof is below 0.1% by weight, anti-wear property and friction-reducing property are not improved. If the amount thereof exceeds 10% by weight, insufficient lubricating performance results.

A known urea compound thickener may be employed as the urea compound used in combination with tricalcium phosphate as a thickening agent. The urea compound is not particularly limited in kind. Examples thereof include diurea, triurea, and tetraurea.

The thickening agent is used in an amount of from 2 to 35% by weight based on the total amount of the composition. In the thickening agent, the proportions of tricalcium phosphate and the urea compound are preferably from 5 to 95% by weight and from 95 to 5% by weight, respectively. This thickening agent may be used in combination with one or more other thickening agents, as long as the content of the sum of the tricalcium phosphate and the urea compound in all the thickening agents is at least 50% by weight.

The base oil is a mineral oil and/or a synthetic oil. Additives such as, e.g., an antioxidant, rust preventive, extreme-pressure additive, and polymer may be further added to the composition of the present invention.

The present invention will be explained by reference to Examples and Comparative Examples, but the invention should not be construed as being limited thereto in any way. Unless otherwise indicated, all parts, percents, ratios and the like are given by weight.

EXAMPLES 1 TO 9 AND COMPARATIVE EXAMPLES 1 TO 11

According to each of the formulations shown in Tables 1 to 6 (all the amount values are given in terms of % by weight), additives were added to a base grease. The resulting mixtures each were kneaded with a three-roll mill to obtain greases of the Examples and Comparative Examples.

The compositions of the base greases are as shown below. As base oils, a refined mineral oil having a viscosity at 100° C. of 15 $mm^2/s$ and a pentaerythritol ester oil having a viscosity at 100° C. of 5 $mm^2/s$ were used as shown in Tables 1–6.

I. Tricalcium phosphate/tetraurea grease (this thickening agent is referred to as Ca/4U in the Tables)

Two moles of diphenylmethane 4,4'-diisocyanate was reacted with 2 mols of stearylamine and 1 mol of ethylenediamine in a base oil. Tricalcium phosphate was then added and homogeneously dispersed thereinto to obtain a grease.

II. Tricalcium phosphate/diurea grease (this thickening agent is referred to as Ca/2U in the Tables)

One mole of diphenylmethane 4,4'-diisocyanate was reacted with 2 mols of octylamine in a base oil. Tricalcium phosphate was then added and homogeneously dispersed thereinto to obtain a grease.

III. Tricalcium phosphate grease

Tricalcium phosphate was homogeneously dispersed into a base oil to obtain a grease.

IV. Tetraurea grease

Two moles of diphenylmethane 4,4'-diisocyanate was reacted with 2 mols of stearylamine and 1 mol of ethylenediamine in a base oil. The urea compound yielded was homogeneously dispersed into the base oil to obtain a grease.

v. Diurea grease

One mole of diphenylmethane 4,4'-diisocyanate was reacted with 2 mols of octylamine in a base oil. The urea compound yielded was homogeneously dispersed into the base oil to obtain a grease.

VI. Lithium soap grease

Lithium 12-hydroxystearate was homogeneously dissolved in a base oil to obtain a grease.

TABLE 1

| Composition | Example 1 | Example 2 | Example 3 |
|---|---|---|---|
| Base oil | | | |
| Mineral oil | 75 | 76 | 79.5 |
| Pentaerythritol ester oil | — | — | — |
| Thickening agent | | | |
| Ca/4U | 20 (80/20) | 20 (80/20) | 17 (50/50) |
| Ca/2U | — | — | — |
| Additive | | | |
| Mo-DTC | 3 | 3 | 3 |
| TPPT | 2 | 1 | 0.5 |
| Total | 100 | 100 | 100 |

(Note)
The pentaerythritol ester oil used was EMERY 2935, manufactured by Emery Industries, Inc.
The ratio given in each ( ) under "Thickening agent" indicates the proportion of tricalcium phosphate to either tetraurea or diurea.
Mo-DTC is sulfurized molybdenum dialkyldithiocarbamate Sakuralube 600, manufactured by Asahi Denka Kogyo K.K.
TPPT is triphenyl phosphorothionate Irgalube TPPT, manufactured by Ciba-Geigy Ltd.

TABLE 2

| Composition | Example 4 | Example 5 | Example 6 |
|---|---|---|---|
| Base oil | | | |
| Mineral oil | 77 | 80 | 79 |
| Pentaerythritol ester oil | — | — | — |
| Thickening agent | | | |
| Ca/4U | 17 (50/50) | 15 (20/80) | 15 (20/80) |
| Ca/2U | — | — | — |
| Additive | | | |
| Mo-DTC | 5 | 3 | 5 |
| TPPT | 1 | 2 | 1 |
| Total | 100 | 100 | 100 |

TABLE 3

| Composition | Example 7 | Example 8 | Example 9 |
|---|---|---|---|
| Base oil | | | |
| Mineral oil | — | 77.5 | 84 |
| Pentaerythritol ester oil | 74 | — | — |
| Thickening agent | | | |
| Ca/4U | 22 (50/50) | — | — |

TABLE 3-continued

| Composition | Example 7 | Example 8 | Example 9 |
|---|---|---|---|
| Ca/2U | — | 17.5 (80/20) | 10 (20/80) |
| Additive | | | |
| Mo-DTC | 3 | 3 | 5 |
| TPPT | 1 | 2 | 1 |
| Total | 100 | 100 | 100 |

TABLE 4

| Composition | Comparative Example 1 | 2 | 3 | 4 |
|---|---|---|---|---|
| Base oil | | | | |
| Mineral oil | 71 | 71 | 72 | 81 |
| Thickening agent | | | | |
| Tricalcium phosphate | 25 | 25 | 25 | — |
| Tetraurea | — | — | — | 14 |
| Diurea | — | — | — | — |
| Lithium soap | — | — | — | — |
| Additive | | | | |
| Mo-DTC | 3 | 3 | — | 3 |
| TPPT | 1 | — | — | — |
| Sulfurized fat or oil | — | — | — | — |
| Lead naphthenate | — | — | — | — |
| Sulfurized olefin | — | — | 3 | — |
| Mo-DTP | — | 1 | — | 2 |
| Total | 100 | 100 | 100 | 100 |

(Note)
The sulfurized fat or oil used was Lubrizol 5006, manufactured by The Lubrizol Corporation.
The lead naphthenate used was Dailube L-30, manufactured by Dainippon Ink & Chemicals, Inc.
The sulfurized olefin used was Lubrizol 5340, manufactured by The Lubrizol Corporation.
Mo-DTP is molybdenum dithiophosphate Sakuralube 300, manufactured by Asahi Denka Kogyo K.K.

TABLE 5

| Composition | Comparative Example 5 | 6 | 7 | 8 |
|---|---|---|---|---|
| Base oil | | | | |
| Mineral oil | 83 | 83 | 82 | 88 |
| Thickening agent | | | | |
| Tricalcium phosphate | — | — | — | — |
| Tetraurea | 14 | 14 | 14 | — |
| Diurea | — | — | — | 9 |
| Lithium soap | — | — | — | — |
| Additive | | | | |
| Mo-DTC | — | — | 3 | 3 |
| TPPT | — | — | 1 | — |
| Sulfurized fat or oil | 3 | — | — | — |
| Lead naphthenate | — | — | — | — |
| Sulfurized olefin | — | 3 | — | — |
| MO-DTP | — | — | — | — |
| Total | 100 | 100 | 100 | 100 |

TABLE 6

| Composition | Comparative Example 9 | 10 | 11 |
|---|---|---|---|
| Base oil | | | |
| Mineral oil | 86 | 88 | 88 |
| Thickening agent | | | |
| Tricalcium phosphate | — | — | — |
| Tetraurea | — | — | — |
| Diurea | — | — | — |
| Lithium soap | 9 | 9 | 9 |
| Additive | | | |
| MO-DTC | — | — | 3 |
| TPPT | — | — | — |
| Sulfurized fat or oil | 3 | — | — |
| Lead naphthenate | 2 | — | — |
| Sulfurized olefin | — | 3 | — |
| Mo-DTP | — | — | — |
| Total | 100 | 100 | 100 |

The grease compositions shown in Tables 1 to 6 were subjected to the following tests to evaluate load carrying capacity, anti-wear property, and heat resistance. The results obtained are shown in Tables 7 to 12.

(1) Load carrying capacity (4-Ball EP test)

Weld load (kgf), last non-seizure load (kgf), and load-wear index were determined in accordance with ASTM D2596.

Rotational speed: 1,770 rpm

Load: prescribed stepwise loading

Temperature: room temperature

Time: 10 sec (2) Anti-wear property (Falex test)

In accordance with IP 241/69 of The Institute of Petroleum in the United Kingdom, the coefficient of friction was determined 15 minutes after the initiation of the test conducted under the following conditions. Rotational speed: 290 rpm Load: 200 lb Temperature: room temperature Time: 15 min Grease amount: about 1 g for each test piece (3) Heat resistance (Thin-film evaporation loss test)

A grease was applied to one side of a 50×70 mm part of a wet-test panel according to JIS Z0236 in an amount of 0.5 g (film thickness, 150 μm). This panel was heated at 150° C. for 24 hours to measure the resulting evaporation loss (wt %)

TABLE 7

| | Example 1 | 2 | 3 |
|---|---|---|---|
| Penetration @ 25° C. Worked, 60 strokes | 336 | 333 | 298 |
| Lubricity under extreme pressure | | | |
| Last Non-seizure Load | 126 | 100 | 126 |
| Weld Load | 315 | 400 | 315 |
| Load-Wear Index | 59 | 56 | 57 |

TABLE 7-continued

| | Example | | |
|---|---|---|---|
| | 1 | 2 | 3 |
| Anti-wear property | 0.080 | 0.092 | 0.085 |
| Coefficient of friction | | | |
| Heat resistance | 10.1 | 9.5 | 10.8 |
| Thin-film evaporation loss | | | |

TABLE 8

| | Example | | |
|---|---|---|---|
| | 4 | 5 | 6 |
| Penetration @ 25° C. Worked, 60 strokes | 317 | 289 | 284 |
| Lubricity under extreme pressure | | | |
| Last Non-seizure Load | 126 | 126 | 100 |
| Weld Load | 400 | 315 | 315 |
| Load-Wear Index | 62 | 60 | 53 |
| Anti-wear property | 0.082 | 0.083 | 0.077 |
| Coefficient of friction | | | |
| Heat resistance | 10.5 | 11.5 | 11.0 |
| Thin-film evaporation loss | | | |

TABLE 9

| | Example | | |
|---|---|---|---|
| | 7 | 8 | 9 |
| Penetration @ 25° C. Worked, 60 strokes | 317 | 297 | 307 |
| Lubricity under extreme pressure | | | |
| Last Non-seizure Load | 100 | 126 | 100 |
| Weld Load | 315 | 315 | 315 |
| Load-Wear Index | 53 | 59 | 53 |
| Anti-wear property | 0.094 | 0.097 | 0.086 |
| Coefficient of friction | | | |
| Heat resistance | 14.5 | 10.4 | 11.6 |
| Thin-film evaporation loss | | | |

TABLE 10

| | Comparative Example | | | |
|---|---|---|---|---|
| | 1 | 2 | 3 | 4 |
| Penetration @ 25° C. Worked, 60 strokes | 282 | 311 | 289 | 296 |
| Lubricity under extreme pressure | | | | |
| Last Non-seizure Load | 126 | 126 | 100 | 100 |
| Weld Load | 315 | 315 | 315 | 250 |
| Load-wear Index | 60 | 63 | 60 | 43 |
| Anti-wear property | 0.112 | 0.119 | 0.125 | 0.099 |
| Coefficient of friction | | | | |
| Heat resistance | 8.3 | 7.7 | 9.1 | 13.7 |
| Thin-film evaporation loss | | | | |

TABLE 11

| | Comparative Example | | | |
|---|---|---|---|---|
| | 5 | 6 | 7 | 8 |
| Penetration @ 25° C. Worked, 60 strokes | 282 | 277 | 360 | 306 |
| Lubricity under extreme pressure | | | | |
| Last Non-seizure Load | 63 | 80 | 80 | 80 |
| Weld Load | 160 | 250 | 200 | 250 |
| Load-Wear Index | 28 | 36 | 44 | 39 |
| Anti-wear property | 0.101 | 0.099 | 0.090 | 0.103 |
| Coefficient of friction | | | | |
| Heat resistance | 14.2 | 16.6 | 13.5 | 13.2 |
| Thin-film evaporation loss | | | | |

TABLE 12

| | Comparative Example | | |
|---|---|---|---|
| | 9 | 10 | 11 |
| Penetration @ 25° C. Worked, 60 strokes | 265 | 277 | 270 |
| Lubricity under extreme pressure | | | |
| Last Non-seizure Load | 50 | 50 | 50 |
| Weld Load | 315 | 250 | 250 |
| Load-Wear Index | 41 | 32 | 37 |
| Anti-wear property | 0.130 | 0.142 | 0.144 |
| Coefficient of friction | | | |
| Heat resistance | flowed | flowed | flowed |
| Thin-film evaporation loss | away | away | away |

(Evaluation)

The grease compositions of Examples 1 to 9 gave excellent results with respect to all of load carrying capacity, anti-wear property, and heat resistance.

On the other hand, the greases of Comparative Examples 1 to 3, which employed tricalcium phosphate as a thickening agent, showed poor anti-wear property. The urea greases of Comparative Examples 4 to 8 showed poor load carrying capacity and heat resistance. Further, the lithium soap greases of Comparative Examples 9 to 11 were clearly inferior in all of load carrying capacity, anti-wear property, and heat resistance.

Embodiments of the present invention are enumerated below.

1. A lubricating grease composition which comprises a grease comprising a base oil and a thickening agent consisting of a mixture of tricalcium phosphate represented by the formula $$Ca_3(PO_4)_2$$

and a urea compound and, incorporated as additives in the grease, (A) a sulfurized molybdenum dialkyldithiocarbamate represented by the formula

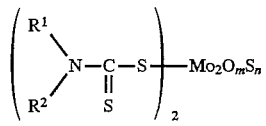

wherein $R^1$ and $R^2$ each independently represents a group selected from the group consisting of alkyl groups having from 1 to 24 carbon atoms; m is 0 or an integer of from 1 to 3; and n is an integer of from 1 to 4; provided that m+n=4 and (B) triphenyl phosphorothionate represented by the formula

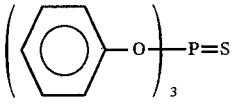

wherein the thickening agent, component (A), and component (B) are present in an amount of from 2 to 35% by weight, from 0.5 to 10% by weight, and from 0.1 to 10% by weight, respectively, based on the total weight of the composition.

2. The lubricating grease composition as described in item 1 above, wherein in the thickening agent, the proportion of the tricalcium phosphate is from 5 to 95% by weight and the proportion of the urea compound is from 95 to 5% by weight.

3. The lubricating grease composition as described in item 1 or 2 above, which has a last non-seizure load of 80 kgf or higher, preferably 100 kgf or higher, a weld load of 250 kgf or higher, a load-wear index of 45 or higher, a coefficient of friction lower than 0.100, and a thin-film evaporation loss of 15.0% by weight or lower.

4. The lubricating grease composition as described in item 3 above, which has a last non-seizure load of 100 kgf or higher, a weld load of 250 kgf or higher, preferably 315 kgf or higher, a load-wear index of 50 or higher, a coefficient of friction lower than 0.100, and a thin-film evaporation loss of 13.0% by weight or lower.

The present invention has succeeded in providing a lubricating grease composition having a high level of performance with respect to each of load carrying capacity, anti-wear property, and heat resistance and having a good balance among these properties.

Specifically, a preferred embodiment of the lubricating grease composition of the present invention has a last non-seizure load of 80 kgf or higher, preferably 100 kgf or higher, a weld load of 250 kgf or higher, preferably 315 kgf or higher, a load-wear index of 45 or higher, preferably 50 or higher, a coefficient of friction lower than 0.100, and a thin-film evaporation loss of 15.0% by weight or lower, preferably 13.0% by weight or lower. Thus, the preferred embodiment shows a high level of effect with respect to each of load carrying capacity, anti-wear property, and heat resistance.

While the invention has been described in detail and with reference to specific embodiments thereof, it will be apparent to one skilled in the art that various changes and modifications can be made therein without departing from the spirit and scope thereof.

What is claimed is:

1. A lubricating grease composition which comprises a grease comprising a base oil and a thickening agent consisting of a mixture of tricalcium phosphate represented by the formula $$Ca_3(PO_4)_2$$

and a urea compound and, incorporated as additives in said grease, (A) a sulfurized molybdenum dialkyldithiocarbamate represented by the formula

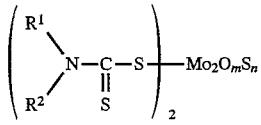

wherein $R^1$ and $R^2$ each independently represents a group selected from the group consisting of alkyl groups having from 1 to 24 carbon atoms; m is 0 or an integer of from 1 to 3; and n is an integer of from 1 to 4; provided that m+n=4 and (B) triphenyl phosphorothionate represented by the formula

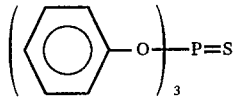

wherein said thickening agent, component (A), and component (B) are present in an amount of from 2 to 35% by weight, from 0.5 to 10% by weight, and from 0.1 to 10% by weight, respectively, based on the total weight of the composition.

2. The lubricating grease composition as claimed in claim 1, wherein in said thickening agent, the proportion of said tricalcium phosphate is from 5 to 95% by weight and the proportion of said urea compound is from 95 to 5% by weight.

3. The lubricating grease composition as claimed in claim 1, wherein component (A) is present in an amount of from 0.5 to 5% by weight, based on the total weight of the composition.

4. The lubricating grease composition as claimed in claim 1, wherein component (B) is present in an amount of from 0.1 to 5% by weight, based on the total weight of the composition.

* * * * *